United States Patent [19]

Going, III

[11] Patent Number: 4,566,534

[45] Date of Patent: Jan. 28, 1986

[54] SOLENOID ACTUATED WELL SAFETY VALVE

[75] Inventor: Walter S. Going, III, Houston, Tex.

[73] Assignee: Camco, Incorporated, Houston, Tex.

[21] Appl. No.: 697,544

[22] Filed: Feb. 1, 1985

[51] Int. Cl.[4] ..... E21B 34/06; E21B 34/16

[52] U.S. Cl. ..... 166/66.4; 166/332; 251/129.21

[58] Field of Search ..... 166/65 M, 316, 332; 251/137–139; 335/253

[56] References Cited

U.S. PATENT DOCUMENTS

| | | | |
|---|---|---|---|
| Re. 30,110 | 10/1970 | Huebsch et al. | 166/65 M |
| 2,245,712 | 6/1941 | Ragan | 166/65 M |
| 3,105,547 | 10/1963 | Ounby | 166/65 M |
| 3,731,742 | 5/1982 | Sizer et al. | 166/53 X |
| 4,002,202 | 1/1977 | Huebsch et al. | 166/316 X |
| 4,160,484 | 7/1979 | Watkins | 166/332 X |
| 4,161,215 | 7/1979 | Bourne, Jr. et al. | 166/65 M |
| 4,191,248 | 3/1980 | Huebsch et al. | 166/65 M |
| 4,280,561 | 7/1981 | Fredd | 166/316 X |
| 4,321,946 | 3/1982 | Paulos et al. | 166/65 M X |
| 4,407,329 | 10/1983 | Huebsch et al. | 166/65 M X |

FOREIGN PATENT DOCUMENTS

| | | | |
|---|---|---|---|
| 2085052 | 4/1982 | United Kingdom | 166/316 |
| 2103689 | 2/1983 | United Kingdom | 166/332 |

*Primary Examiner*—Stephen J. Novosad
*Assistant Examiner*—John F. Letchford
*Attorney, Agent, or Firm*—Fulbright & Jaworski

[57] ABSTRACT

A subsurface solenoid operated well safety valve which is locked in the open position, after being opened by the solenoid, for preventing the valve from closing by various forces overcoming the solenoid. A valve closure member in the bore of a housing moves between open and closed positions and is controlled by a tubular member which is biased in a direction to close the valve. An armature is movable in the housing and a solenoid coil is energized to move the armature. A first releasable lock connects the armature to the tubular member for allowing the movement of the solenoid to open the valve. The first lock is released when the valve is opened. A second releasable lock locks the tubular member to the housing in the open position prior to the release of the first lock means. The de-energization of the coil releases the armature and the second lock to allow the valve to close.

13 Claims, 4 Drawing Figures

SOLENOID ACTUATED WELL SAFETY VALVE

BACKGROUND OF THE INVENTION

It is known to provide a subsurface safety valve operated by a solenoid coil. U.S. Pat. No. 3,731,742 discloses in one form a safety valve which is moved mechanically to the open position by a well tool and is locked in the open position by a detent. The valve is triggered to the closed position by actuating a solenoid for releasing the detent. U.S. Pat. Nos. 4,191,248 and Re. 30,110 disclose subsurface solenoid actuated safety valves in which the solenoid mechanism performs the function of opening the valve and is fail-safe in that the valve will close in the event that electrical power is lost. However, these valves will undesirably close if various well forces overcome the power of the solenoid such as if the flow velocity through the well tubing increases or if well tools moving upwardly in the safety valve engage and cause the safety valve to close.

The present invention is directed to a fail-safe subsurface solenoid actuated well safety valve in which the solenoid, when energized, will move the valve to the open position and thereafter the valve is positively locked in the open position for eliminating the possibility that various forces in the well could overcome the force of the solenoid and undesirably close the valve.

SUMMARY

The present invention is directed to a solenoid actuated well safety valve including a housing having a bore, a valve closure member in the bore moving between open and closed positions, a tubular member telescopically movable in the housing for controlling the movement of the valve closure means, and biasing means acting on the tubular member for moving the tubular member in a direction to close the valve. An armature is movable in the housing and a solenoid coil is positioned adjacent the housing for moving the armature. A first releasable lock means is provided for connecting the armature to the tubular member whereby movement of the armature by energization of the solenoid will open the valve, and the first lock means is released when the valve is opened. A second releasable lock means is provided for locking the tubular member in the open position prior to the release of the first lock means for positively locking the valve in the open position.

Still a further object of the present invention is wherein the second lock means locks the tubular member in the open position to the housing.

Yet a still further object is wherein the second lock means is locked and released by movement of the armature and biasing means is provided acting to move the armature away from the solenoid coil.

Yet a still further object of the present invention is wherein the first lock means includes a movable first dog carried by the armature and the tubular member includes a locking notch. A releasable locking shoulder is carried by the armature for releasable locking the first dog into the notch.

A still further object is wherein the second lock means includes a movable second dog carried by the housing and the tubular member includes a holding notch. A locking shoulder is carried by the armature for releasable locking the second dog into the holding notch.

Yet a further object of the present invention is wherein the housing includes a stop shoulder for engaging the locking shoulder carried by the armature for releasing the first locking means on movement of the valve to the open position.

Yet a further object is wherein the holding notch is sufficiently wide to allow the second lock means to lock and allow movement of the tubular member to release the first lock means.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

While the solenoid safety valve of the present invention will be described in connection with a tubing retrievable type valve using a flapper valve element, for purposes of illustration only, it is to be understood that the present invention is applicable to other types of safety valves and other safety valves utilizing other types of valves closure means.

Figure 2A:
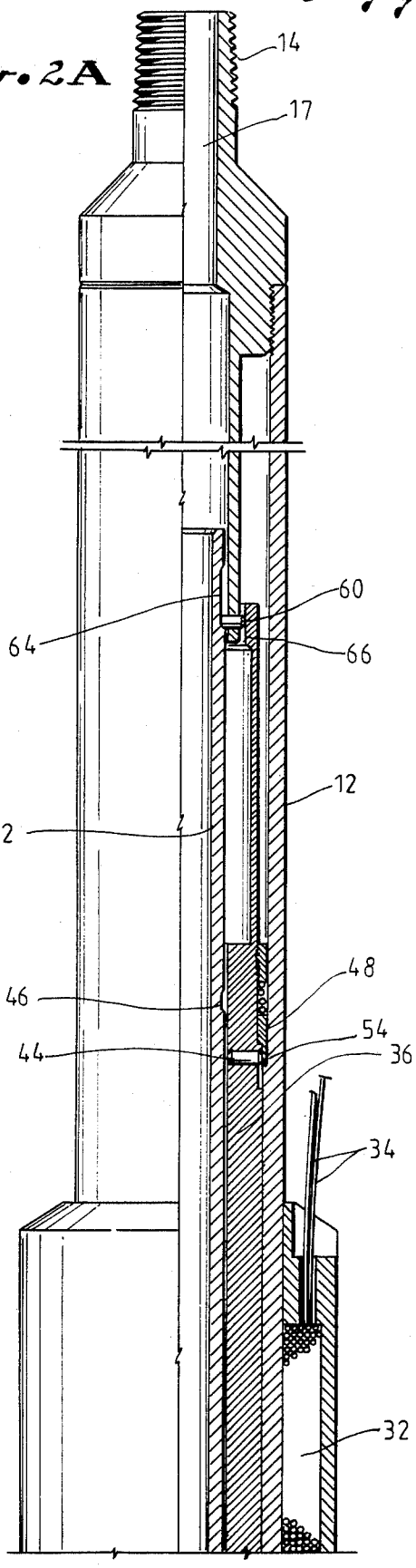
FIGS. 2A and 2B are continuations of each other of the valve of FIGS. 1A and 1B, but in the open position.
Figure 2B:
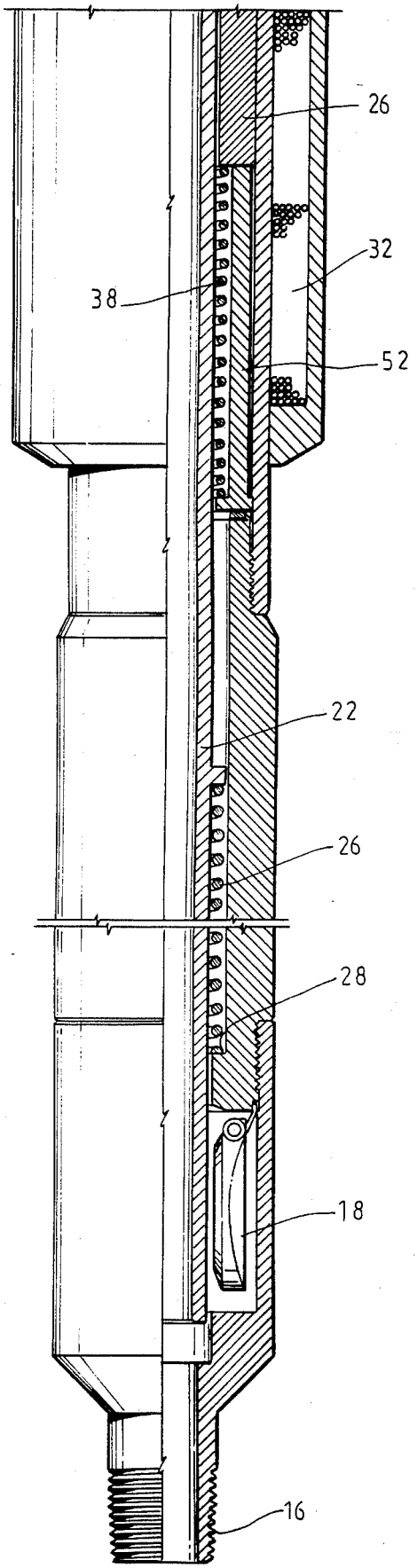

Referring now to the drawings, the reference numeral 10 generally indicates the solenoid actuated well safety valve of the present invention and includes a housing 12 which may have upper 14 and lower 16 threaded connections for connecting into a well tubing and includes a bore 17 therein. A valve closure member 18 such as a flapper valve is positioned in the bore 17 and may be connected to pivot 20 for moving to a closed position as best seen in FIG. 2B for allowing flow through the valve 10. A tubular member 22 is telescopically movable in the housing 12 for controlling the movement of the valve closure member 18. When the tubular member 22 is in the upward position the flapper 18 is allowed to move to the closed position by a spring 24. However, when the tubular member 22 is moved downwardly it moves the flapper valve 18 off of its seat thereby opening the valve.

Figure 1A:
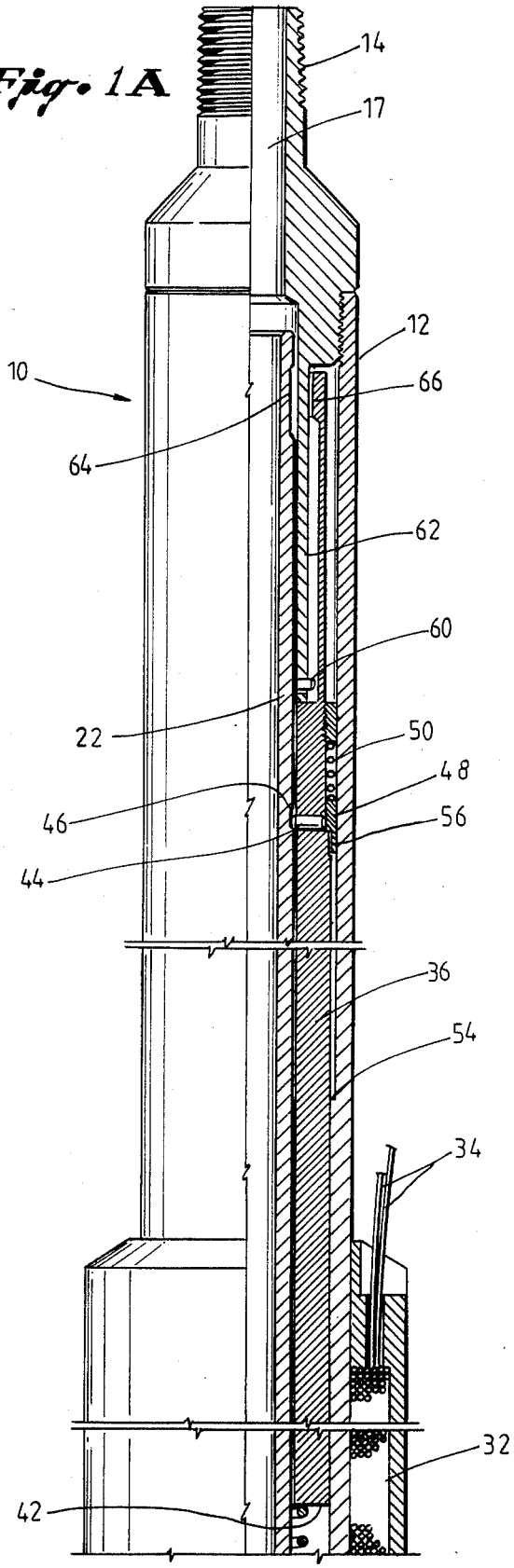
FIGS. 1A and 1B are elevational views, in quarter section of the solenoid safety valve of the present invention shown in the closed position.

Various forces can be provided for controlling the movement of the tubular member 22. Thus, biasing means such as a spring 26 may be positioned in the housing 12 between a shoulder 28 in the housing and a shoulder 30 on the tubular member 22 for biasing the tubular member 22 in a direction to close the valve 10. In addition, a solenoid electrical coil 32 is provided connected to the housing 12 and energized by one or more electrical lines 34 which are adapted to extend to the well surface for energizing and de-energizing the electrical coil 32. A magnetic armature 36 is telescopically movable in the housing 12 and is adapted to be attracted by the solenoid coil 32 and move from an upward position, as best seen in FIG. 1A, to a downward position as best seen in FIGS. 2A and 2B for moving the tubular member 22 to a downward position for opening the valve 10. When the coil 32 is deactuated the armature 36 will move upwardly by the action of biasing means such as a spring 38 positioned between a shoulder 40 on the housing 12 and a shoulder 42 on a magnetic stop 52. The use of a solenoid coil and armature for actuating a well safety valve is disclosed in U.S. Pat. No. Re. 30,110. However, in that valve, the upward flow of well fluids can ovecome the force of the solenoid valve and close the valve.In addition, upward moving well tools could engage the tubular member and close the valve or even trap the well tools in the safety valve.

The present invention is direction to an improved solenoid safety valve in which the valve is positively locked in the open position when the solenoid is energized for eliminating the possibility that the valve may be closed by forces overcoming the magnetic attraction force of the solenoid coil. Referring now to FIG. 1A, a first releasable lock means is provided for connecting the armature 36 to the tubular member 22 whereby attraction of the armature 36 by the solenoid coil 32 will move the armature 36 and tubular member 22 downwardly to open the valve 10. A first dog 44 is movably carried by the armature 36 for movement in a radial direction inwardly towards the tubular member 22 and outwardly from the tubular member 22. The tubular member 22 includes a locking notch 46 for receiving the dog 44 for releasably locking the tubular member 22 to the armature 36. The dog 44 is initially held in the locked position by a locking shoulder 48 which is biased to the locking position by a spring 50. Therefore, when the armature 36 is attracted by the solenoid coil 32 and moves downwardly it will carry the tubular member 22 downwardly to open the valve 10. As best seen in FIGS. 2A and 2B, the armature 36 will move downwardly towards a magnetic stop 52, but before the armature 36 reaches the full extent of its downward movement, the movable shoulder 48 will contact a stop shoulder 54 in the housing 12 stopping further downward movement of the locking shoulder 48. However, the armature 36 and tubular member 22 continues downwardly and the dog 44 moves downwardly from the locking shoulder 48, moves outwardly into a recess 56 in the locking shoulder 48, and releases the tubular member 22 from he armature 36.

However, a second releasable lock means is provided for locking and holding the tubular member 22 in the open position prior to the release of the dog 44. The second releasable locking means includes a second radially movable dog 60 movable in a portion 62 of the housing 12 and adjacent the tubular member 22. The dog 60 is adapted to be moved into a holding notch 64 in the tubular member 22 by movement of a locking shoulder 66 carried by the armature 36. It is noted in FIG. 1A that the locking shoulder 66 is generally in horizontal alignment with the holding notch 64 and both move downwardly together as the tubular member 22 and armature 36 move toward the open position.

Referring now to FIG. 2A, prior to the time that the dog 44 is released, the locking shoulder 66 engages the back side of the second dog 60 and moves the dog 60 and locks it into the holding notch 64. The locking notch 64 is sufficiently wide to allow the second dog 60 to engage the holding notch 64 and still allow downward movement of the tubular member 22 for purposes of releasing the first lock means. After the first dog 44 is released, the biasing spring 26 will move the tubular member 22 upwardly a small distance to cause the holding notch 64 to bottom out against the second dog 60. Thus, as best seen in FIGS. 2A and 2B, the valve 10 is locked in the open position by having the tubular member 22 releasably locked to the housing 12 with a positive lock whereby upward forces in the well bore 17 cannot overcome the force of the solenoid coil 32 and undesirably close the valve 10. In the open position, the coil 32 is still energized to hold the armature 36 downwardly which in turn holds the locking shoulder 66 against the second dog 60 for maintaining the dog 60 in the notch 64 and locked position.

The valve 10 is a fail-safe valve in that the valve 10 will remain open so long as the solenoid coil 32 is energized. When it is desired to close the valve or in the event of a loss of electrical power to the coil 32, the valve will close. That is, when the solenoid coil 32 is de-energized, the spring 38 will move the armature 36 and its connected locking shoulder 66 upwardly thereby releasing the second dog 60 and the spring 26 will then move the tubular member 22 upwardly to allow the valve closure member 18 to close. When the tubular member 22 and the armature 36 are moved to their upward position, as best seen in FIG. 1A, the spring loaded locking shoulder 48 again moves downwardly engaging the first dog 44 and moves it into the locking notch 46 to place the valve 10 in condition for opening upon energization of the coil 32.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. A solenoid actuated well safety valve comprising, a housing having a bore, a valve closure member in the bore moving between open and closed positions, a tubular member telescopically movable in the housing for controlling the movement of the valve closure member, biasing means acting on said tubular member for moving the tubular member in a direction to close said valve, an armature movable in the housing, a solenoid coil positioned adjacent the housing for moving the armature, first releasable lock means for connecting the armature to the tubular member whereby movement of the armature by the solenoid will open the valve, and said first lock means being released when the valve is opened, and second releasable lock means for locking the tubular member in the open position prior to the release of the first lock means.

2. The apparatus of claim 1 wherein the second lock means locks the tubular member to the housing.

3. The apparatus of claim 2 wherein the second lock means is locked and released by movement of the armature.

4. The apparatus of claim 1 including biasing means acting to move the armature away from the solenoid coil.

5. The apparatus of claim 1 wherein the first lock means includes, a movable first dog carried by the armature, and said tubular member includes a locking notch, a locking shoulder carried by the armature for locking said first dog into said notch.

6. The apparatus of claim 1 wherein the second lock means includes, a movable second dog carried by the housing, and said tubular member includes a holding notch, and a locking shoulder carried by the armature for locking said second dog into the holding notch.

7. The apparatus of claim 5 wherein the housing includes a stop shoulder for engaging said locking shoulder for releasing said first locking means on movement of the valve to the open position.

8. A solenoid actuated well safety valve comprising, a housing having a bore, a valve closure member in the bore moving between open and closed positions, a tubular member telescopically movable in the housing for controlling the movement of the valve closure member, biasing means acting on said tubular member for moving the tubular member in a direction to close said valve, an armature movable in the housing, a solenoid coil positioned adjacent the housing for attracting and releasing said armature, biasing means in the housing for moving said armature when the armature is released, first releasable lock means for connecting the armature to the tubular member whereby movement of the armature by the solenoid will open the valve, and said first lock means being released when the valve is opened, and second releasable lock means operable by movement of the armature for locking the tubular member in the open position to the housing prior to the release of the first lock means.

9. The apparatus of claim 8 including, means on the housing for releasing the first lock means.

10. The apparatus of claim 8 wherein the first lock means includes a movable first dog carried by the armature, and said tubular member includes a locking notch, a spring loaded movable locking shoulder carried by said armature for locking said first dog into said notch.

11. The apparatus of claim 10 including, a releasing shoulder on the housing for engaging the movable locking shoulder for releasing the first dog on movement of the armature to the valve open position.

12. The apparatus of claim 11 wherein the second lock means includes, a movable second dog carried by the housing, and said tubular member includes a holding notch, and a releasable locking shoulder carried by the armature for locking and releasing said second dog into and from the holding notch.

13. The apparatus of claim 12 wherein the holding notch is sufficiently wide to accommodate the second dog while the tubular member and armature moves for releasing the first lock means.

* * * * *

UNITED STATES PATENT OFFICE

CERTIFICATE OF CORRECTION

Patent No. 4,566,534 Dated January 28, 1986

Inventor(s) Walter S. Going, III

Figure 1B:
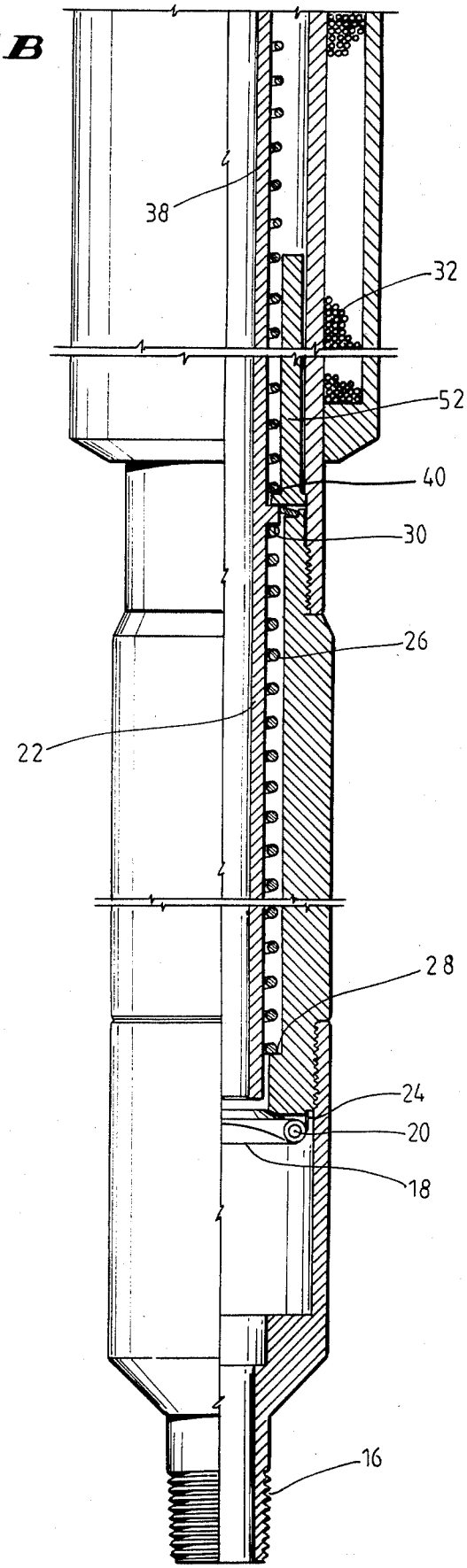

It is certified that error appears in the above-identified patent and that said Letters Patent are hereby corrected as shown below:

Column 2, line 40, after "in" insert -- FIG. 1B for blocking flow therethrough or moving to an open position as best seen in --

Column 3, line 9, delete "direction" and insert --directed--

Signed and Sealed this

*Thirteenth* Day of *May 1986*

[SEAL]

*Attest:*

DONALD J. QUIGG

*Attesting Officer*

*Commissioner of Patents and Trademarks*